US005212519A

United States Patent [19]

Kasahara et al.

[11] Patent Number: 5,212,519

[45] Date of Patent: May 18, 1993

[54] IMAGE FORMING APPARATUS WITH MEMORY CARD

[75] Inventors: Seitaro Kasahara; Minoru Asakawa; Yasunori Ohgo, all of Tokyo, Japan

[73] Assignee: Konica Corporation, Tokyo, Japan

[21] Appl. No.: 832,226

[22] Filed: Feb. 7, 1992

[30] Foreign Application Priority Data

Feb. 12, 1991 [JP] Japan ..... 3-18947

[51] Int. Cl.[5] ..... G03G 15/00

[52] U.S. Cl. ..... 355/200; 355/201; 355/308; 235/382

[58] Field of Search ..... 355/200, 201, 202, 204, 355/308; 235/375, 382, 382.5

[56] References Cited

U.S. PATENT DOCUMENTS 4,780,806 10/1988 Wada et al. ..... 355/200 X
4,998,195 3/1991 Ito et al. ..... 355/200 X

FOREIGN PATENT DOCUMENTS 61-277976 12/1986 Japan ..... 355/201
1-250967 10/1989 Japan ..... 355/201

*Primary Examiner*—Joan H. Pendegrass

*Attorney, Agent, or Firm*—Frishauf, Holtz, Goodman & Woodward

[57] ABSTRACT

An image forming apparatus comprises an inner memory, first checking means, second checking means, a mode selector, judging means and a portable memory. The portable memory is adapted to be connected to the main body of the apparatus and memorizes a portable memory identification number to identify the same portable memory and a plurality of usable apparatus numbers to represent usable image forming apparatuses which become usable by the connection of the same portable memory. The inner memory memorizes an apparatus identification number to identify the image forming apparatus and a plurality of acceptable portable memory numbers to represent portable memories acceptable for the same image forming apparatus. The first checking means checks if the apparatus identification number coincides with any of the usable apparatus numbers, and the second checking means checks if, the portable identification number coincides with any of the acceptable portable memory numbers. The mode selector selects a check mode which determines a combination of checks to be performed by the first and the second checking means, and the judging means allows usage of the image forming apparatus based on the result of the combined checks.

3 Claims, 17 Drawing Sheets

FIG. 4-a
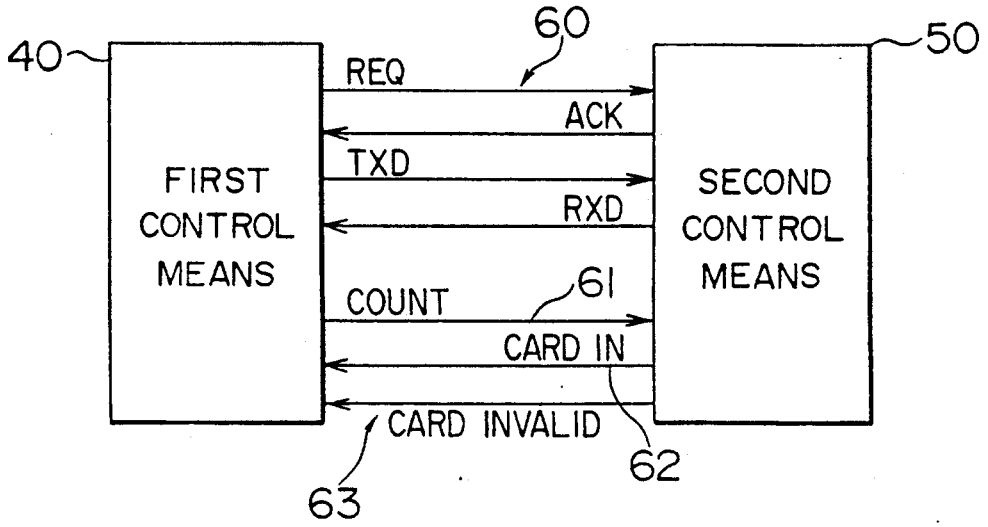
FIG. 4-b
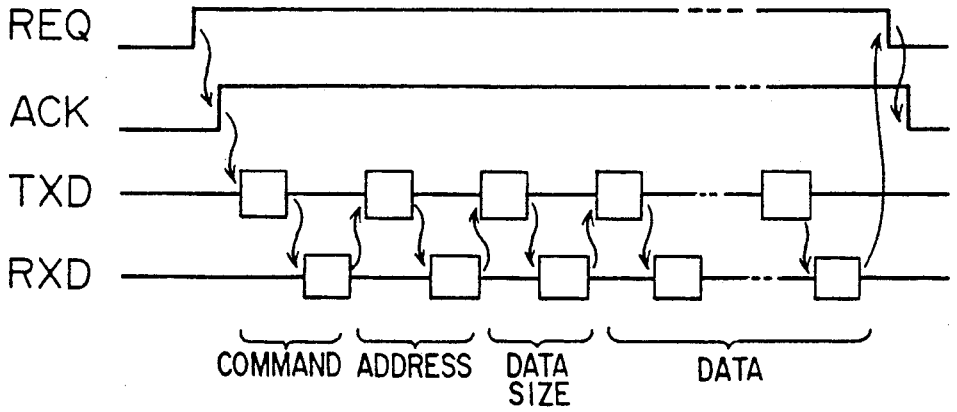
FIG. 4-c
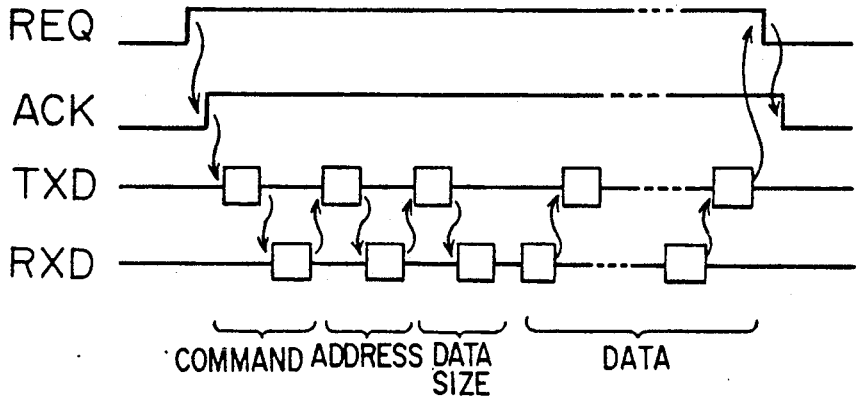

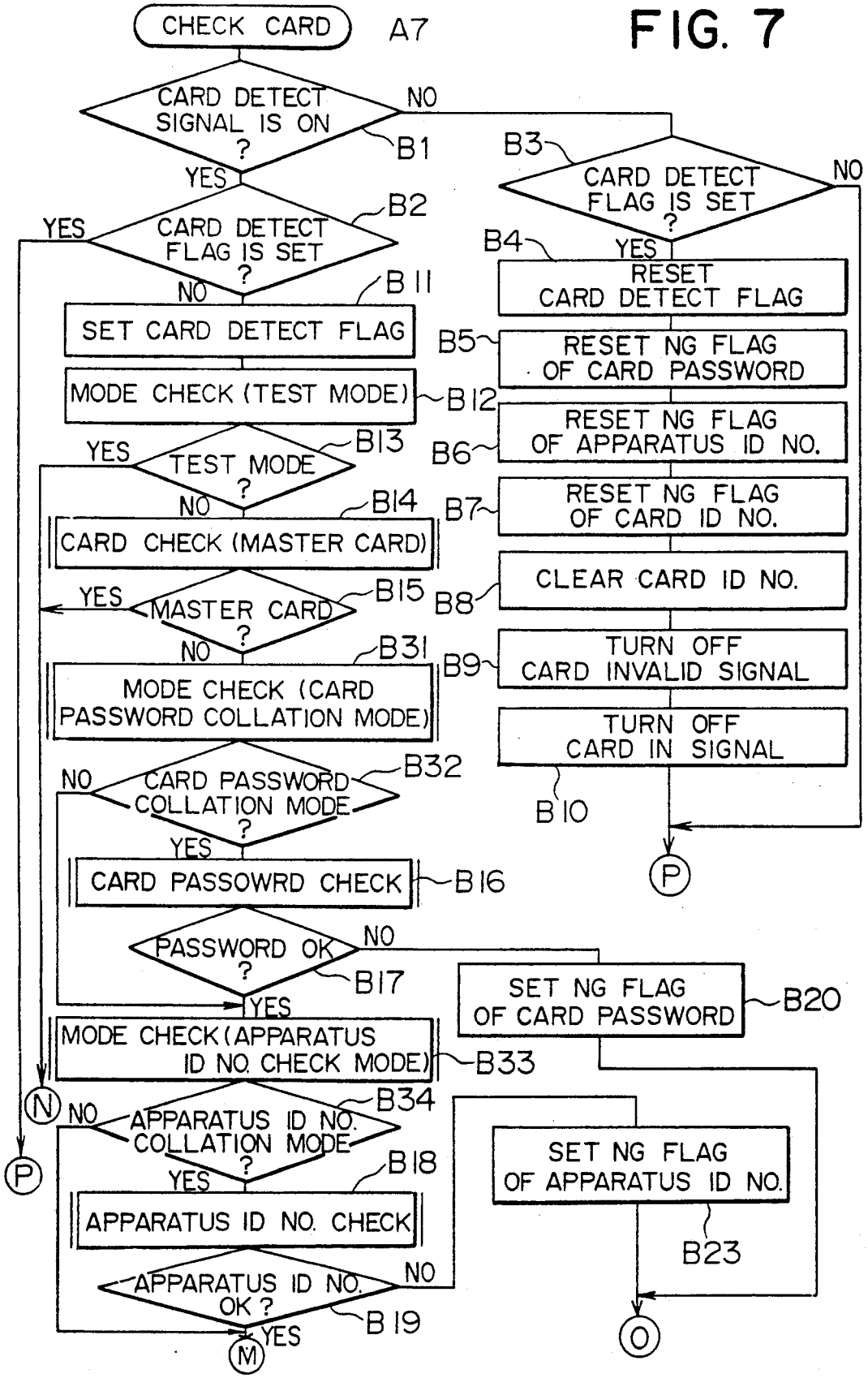
FIG. 7
CHECK CARD
A7
CARD DETECT SIGNAL IS ON ?
B1
NO
YES
CARD DETECT FLAG IS SET ?
B2
YES
NO
SET CARD DETECT FLAG
B11
MODE CHECK (TEST MODE)
B12
TEST MODE ?
B13
YES
NO
CARD CHECK (MASTER CARD)
B14
MASTER CARD ?
B15
YES
NO
MODE CHECK (CARD PASSWORD COLLATION MODE)
B31
CARD PASSWORD COLLATION MODE ?
B32
NO
YES
CARD PASSOWRD CHECK
B16
PASSWORD OK ?
B17
NO
YES
SET NG FLAG OF CARD PASSWORD
B20
MODE CHECK (APPARATUS ID NO. CHECK MODE)
B33
N
APPARATUS ID NO. COLLATION MODE ?
B34
NO
YES
P
APPARATUS ID NO. CHECK
B18
SET NG FLAG OF APPARATUS ID NO.
B23
APPARATUS ID NO. OK ?
B19
NO
YES
M
O
B3
CARD DETECT FLAG IS SET ?
NO
YES
B4
RESET CARD DETECT FLAG
B5
RESET NG FLAG OF CARD PASSWORD
B6
RESET NG FLAG OF APPARATUS ID NO.
B7
RESET NG FLAG OF CARD ID NO.
B8
CLEAR CARD ID NO.
B9
TURN OFF CARD INVALID SIGNAL
TURN OFF CARD IN SIGNAL
B10
P

IMAGE FORMING APPARATUS WITH MEMORY CARD

BACKGROUND OF THE INVENTION

The present invention relates to an image forming apparatus such as an electrophotographic copier, which is connected with an outside memory means by electrical means, electrical wave means or optical means in order to control the operation of an outside memory means and the image forming apparatus; for example, in order to positively count the number of copied sheets.

Recently, image forming apparatus, such as copiers, have been widely used, and their performance and functions have made noteworthy progress. These highly functional copiers differ from simple copiers for personal use. In many cases, they are installed in an office and shared by several sections. In this case, expenses may need to be paid by each section according to the number of copied sheets. Therefore, the following means has been adopted: a plurality of portable memory cards (portable memory means) in which the code number of each member of personnel and that of each section are stored, are prepared as an outer memory means; and when a copy operation is performed, this memory card is set to the copy apparatus so that the number of copy sheets can be controlled. For example, this technique is disclosed in the official gazettes of Japanese Patent Application Open to Public Inspection Nos. 165664/1985, 277976/1986, 96958/1987, 96966/1987, and 105964/1989.

In this case, the memory card which is a functional outer memory means is composed in such a manner that: an ID number is registered in the memory card as a card ID number; in the image forming apparatus, a card ID number is stored which is available for the apparatus; when the card ID number stored in the memory card coincides with that registered in the image forming apparatus, image formation can be performed; every time when image formation is performed, the number of image formation is stored in the memory card in order to control the number of copy sheets; and when the card ID number stored in the memory card does not coincide with that registered in the image forming apparatus, image formation can not be performed and the memory card is made invalid.

When the memory card is used in the manner described above, there is a possibility that the following problem occurs. For example, when everybody keeps this memory card and utilizes various copiers, some copiers will not work, depending on the card ID number stored in the memory card.

SUMMARY OF THE INVENTION

It is a primary object of the present invention to provide an image forming apparatus characterized in that: even when various kinds of copiers are provided, an outer memory means such as a memory card, IC card, magnetic card and a remote control means to which an electric wave or light is applied, is utilized so that checking the ID number stored in the memory card with that registered in the copier can be easily and accurately performed.

In order to attain the aforementioned object, the present invention is to provide an image forming apparatus comprising: an outer memory means which can be connected to the image forming apparatus; a first memory means which stores a plurality of available image forming apparatus ID numbers stored in said outer memory means, and the image forming apparatus ID number; a first check means which checks said image forming apparatus ID number with said available image forming ID numbers; a second memory means which stores an outer memory means ID number stored in said outer memory means, and a plurality of available memory means ID numbers; a second check means which checks said outer memory means ID number with said available outer memory ID numbers; a check mode selecting means which selects a check mode from the combination of said first and second check means; an image formation permission judging means which judges image formation permission from the result of the check according to the check mode selected by the check mode selection means; and a control means which carries out image formation according to the result of judgment conducted by the image formation permission judging means.

In the image forming apparatus of the present invention, a highly functional outer memory means is utilized which can be attached to and detached from the image forming apparatus, and a plurality of available image forming apparatus ID numbers are stored in the outer memory means. Further, the image forming apparatus is provided with first and second memory means which store ID numbers corresponding to the plurality of outer memory means. A plurality of available image forming ID numbers are checked with the aforementioned first and second memory means at each stage, and the check mode can be selected and the check by the outer memory means ID number can be also conducted. Further, the check of the image forming apparatus ID number can be also conducted. Furthermore, a check in which the aforementioned two check operations are combined, can be selectively conducted.

BRIEF DESCRIPTION OF THE DRAWINGS

FIG. 4-*a* is a transmission circuit diagram showing communication and pulse count;

FIGS. 4-*b* and 4-*c* are time charts of sending and receiving;

FIG. 7 is a flow chart of card check (detection);

DETAILED DESCRIPTION OF THE PREFERRED EMBODIMENTS

Figure 1:
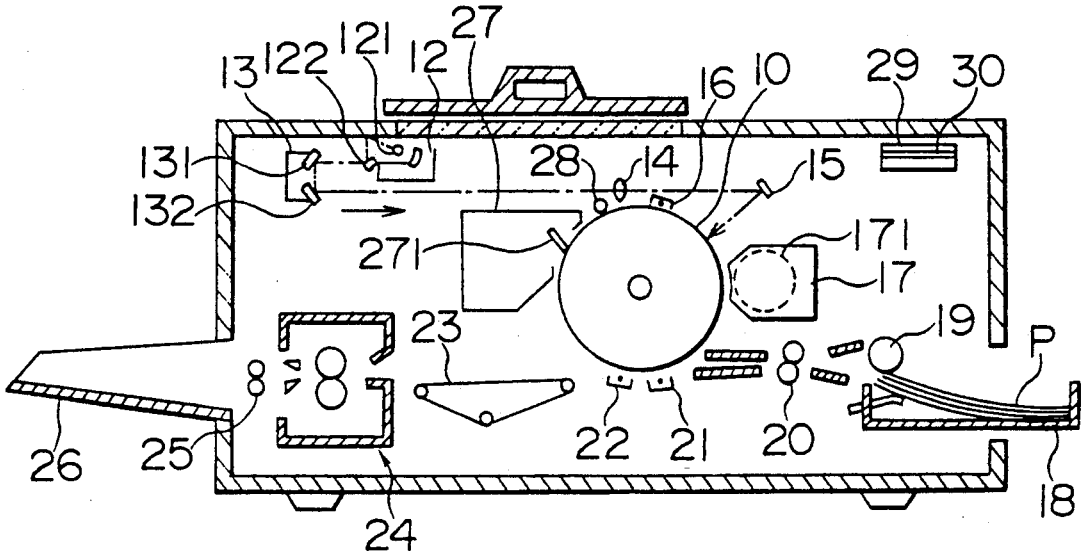
FIG. 1 is a sectional view showing the main structure of the image forming apparatus according to the present invention.

Referring now to the attached drawings, the present invention will be explained as follows. FIG. 1 is a sectional view showing the main composition of an example of the copier according to the present invention.

First, the copy process of this copier will be briefly explained.

A photoreceptor drum 10 on which a photosensitive layer is coated or vapor-deposited, is rotated clockwise by a drive means not shown. While the photoreceptor drum 10 is being rotated, the residual toner on the photoreceptor drum 10 is removed by a cleaning means 27 which will be explained later, and a precharging exposure lamp 28 is lit so that the electrical charge remaining locally on the circumferential surface of the photoreceptor drum 10 can be removed. Then, the photosensitive layer of the photoreceptor drum 10 is uniformly charged by a charger 16.

A halogen lamp 121 mounted on a carriage 12 which horizontally slides synchronously with the rotation of the photoreceptor drum 10, irradiates document D which is set on a platen 11. Light emitted by the halogen lamp is reflected on document D. The reflected light passes through a slit (not shown), mirror 122, mirrors 131, 132 mounted on a movable mirror unit 13, lens 14 and mirror 15, and then an image is formed on the photoreceptor drum 10 which will be described later. That is, the photoreceptor drum 10 is exposed with the light reflected on document D, and an electrostatic latent image is formed on the surface.

The aforementioned carriage 12 and movable mirror unit 13 are driven by a stepping motor through a wire connected with the stepping motor, and moved respectively in the same direction at speed V and ½ V.

Next, this electrostatic latent image is developed by a developing unit 17 in which toner is accommodated so that a toner image is formed on the surface of the photoreceptor drum 10. A bias of AC or DC is impressed upon a developing sleeve 171 of the developing unit 17, and reversal development is conducted on the latent image formed on the photoreceptor drum 10 which is grounded.

The toner image formed on the photoreceptor drum 10 is transferred onto transfer sheet P which is supplied from a paper cassette 18 by a paper feed roller 19 and conveyed to the transfer section by a timing roller 20 synchronously with the aforementioned toner image. Transfer is conducted by a transfer unit 21 which impresses a high voltage of polarity reverse to the toner.

Then, transfer sheet P onto which the toner image has been transferred, is positively separated from the peripheral surface of the photoreceptor drum 10, and conveyed to a fixing means 24 by a conveyance belt 23. After the toner image on transfer sheet P has been fused and fixed, it is discharged by a paper discharge roller 25 onto a paper discharge tray 26 provided outside the apparatus.

After the toner image has been transferred onto transfer sheet P, the photoreceptor drum 10 is further rotated clockwise, and the residual toner on the photoreceptor drum 10 is removed by a cleaning means 27 having a cleaning blade 271 which comes into contact with the peripheral surface of the photoreceptor drum 10 with pressure. After the aforementioned cleaning operation has been completed, a new copy process starts.

Figure 2:
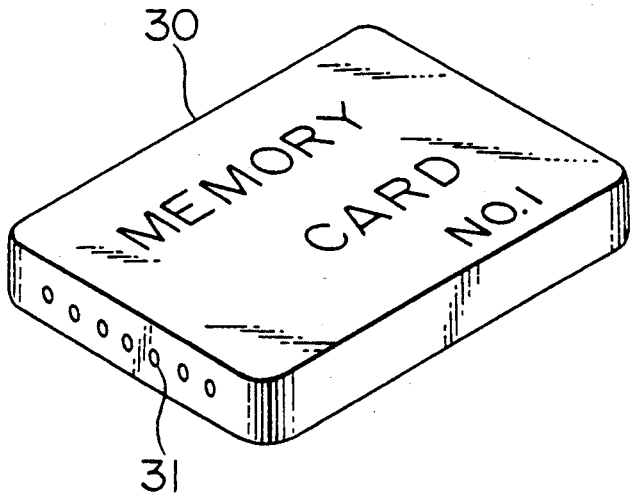
FIG. 2 is a perspective view of a card (a portable memory means) according to the present invention.

FIG. 2 is a perspective view showing a plurality of cards 30 which can be utilized for an outer memory means, that is, a portable memory means according to the present invention. These cards 30 are available for use with a plurality of image forming apparatus. Also, these cards 30 have a nonvolatile memory, such as portable memory cards and IC cards. A plurality of memory cards can be available to one image forming apparatus, or one or a plurality of memory cards may be available to a plurality of image forming apparatus. The memory cards are distributed to each section or worker in an office. When the card 30 is utilized, it is inserted into a slot (not shown) formed around a control panel of the image forming apparatus, and set to a setting section 29 of the apparatus. When the card 30 is set to the setting section 29 of the apparatus, an output and an input terminal 31 provided to the card 30 are electrically connected with a connecting section (not shown) of the second control means 50, which will be described later, so that signals can be transmitted. ID numbers corresponding to the card 30, the section in the office, the image forming apparatus available for this card, and the name of the person, can be stored in ID number memory means 32 of the card 30. For central control use, the number of copy sheets according to each section, each person, and the size of the transfer sheet, or total number of copy sheets, can be stored in a counter memory means 34. In the case of a color image forming apparatus, the sequence program of the image forming process control may be stored which is different from mode to mode, such as formation of a monochrome image, a monocolor image and a full color image.

Figure 3:
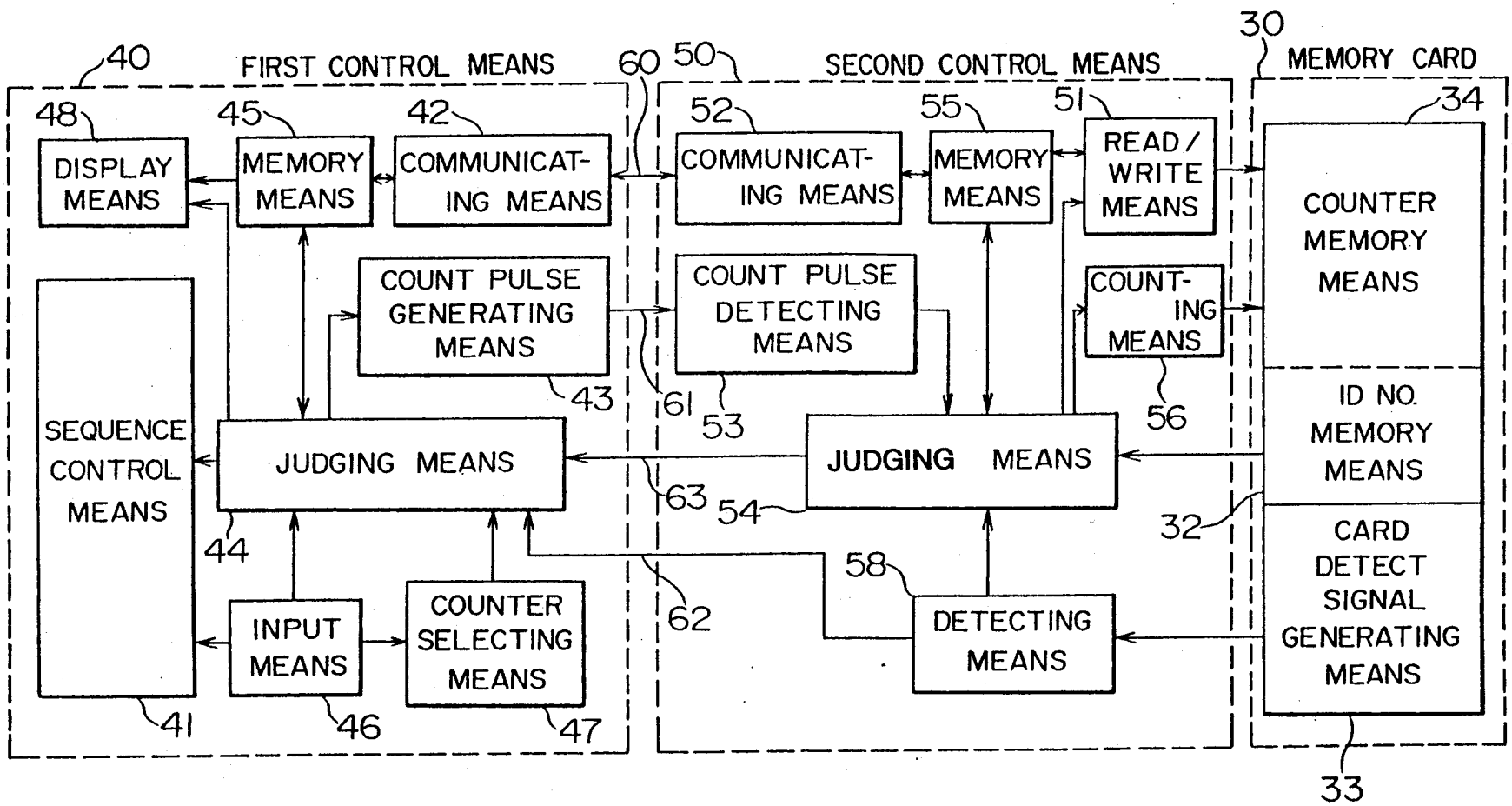
FIG. 3 is a block diagram showing the control structure of the present invention.

FIG. 3 is a block diagram showing the control structure of the image forming apparatus according to the present invention. The first control means 40 and the second control means 50 are provided in the image forming apparatus. The card 30 can be attached to the second control means 50.

The first control means 40 comprises a sequence control means 41 to conduct the process control, a communication means 42 to communicate with the second control means, a count pulse generation means 43 to generate pulses in accordance with the number of image formation, a judging means 44 to conduct various judgments, a memory means 45 to store ID numbers of the image forming apparatus and available cards, an input means 46 into which various image forming process modes and ID numbers are inputted, a counter designating means 47 to designate a counter, and a display means 48 to display on a display section (not shown) of a control panel (not shown).

The second control means 50 provided in the card setting section 30 comprises a reading-out/writing-in means 51 which conducts reading-out and writing-in of information on the card, a communication means 52 to communicate with the first control means, a count pulse detection means 53 to detect count pulses generated in the aforementioned count pulse generation means 43, a judgment means 54 to conduct various judgments, a memory means 55 to store information obtained by the communication means 52, a count means 56 to conduct counting of the card 30 on the counter memory means 34, a detection means 58 to detect that the card 30 has been set to the setting section 29, and a connecting section which is connected with the terminal 32 of the card 30.

The first control means 40 which mainly conducts sequence control of the process, is disposed in a suitable position inside the image forming apparatus. The second control means 50 which mainly conducts control of reading-out and writing-in of the card 30, is disposed in the card setting section 29, so that restriction of space can be largely reduced.

The communication means 42 of the first control means 40 and the communication means 52 of the second control means 50 are connected by a serial communication means 60. The count pulse generation means 43 of the first control means 40 and the count pulse detection means 53 of the second control means 50 are connected by a count pulse transmission means 61. The judging means 44 of the first control means 40 and the detection means 58 of the second control means 50 are connected by a card-in transmission means 62. The judging means 44 of the first control means 40 and the judging means 54 are connected by a card-invalid means 63.

FIG. 4-*a* is a detailed view of the communication means 60 and count pulse transmission means 61. The communication means 60 is composed of 4 lines. Data is transmitted from the first control means 40 to the second control means 50 through REQ and TXD lines, and also data is transmitted from the second control means 50 to the first control means 40 through ACK and RXD lines, wherein data is sent and received by a transmission format with 8 bit code. Transmitted data is responded in order to check errors.

FIG. 4-*b* is a time chart of data transmission from the first control means 40 to the second control means 50. Command, memory address, bite number, data size and data are sequentially transferred. Data is temporarily stored in the memory means 55 provided in the second control means 50, and when there is no error, data is written in the card 30. FIG. 4-*c* is a time chart of data transfer to the first control means 40.

The count pulse transmission means 61 comprises a COUNT line which transfers a count pulse from the first control means 40 to the second control means 50, and the count pulse is detected by the count pulse detection means 53 provided in the second control means 50. The card-in transmission means 62 comprises a card-in line which sends a card-in signal when the detection means 58 detects that the card 30 has been set to the setting section 29, and which transfers the card-in signal from the detection means 58 of the second control means 50 to the first control means 40. This card-in signal is detected by the judging means 44 installed in the first control means 40. The card-invalid transmission means 63 comprises a card-invalid line which transfers a card invalid signal to the first control means 40 from the judging means 54 of the second control means 50, so that the card-invalid signal is detected by the judging means 44 provided in the first control means 40.

When a signal, the amount of information of which is small, such as a count signal, card-in signal and card-invalid signal, is transferred, the aforementioned communication transmission means 60 is not utilized, but an exclusive count pulse transmission means 61, card-in transmission means 62 and card-invalid transmission means 63 are provided, so that the transmission time is shortened and response property can be improved, and further, control can be conducted by a simple program.

Figure 5:
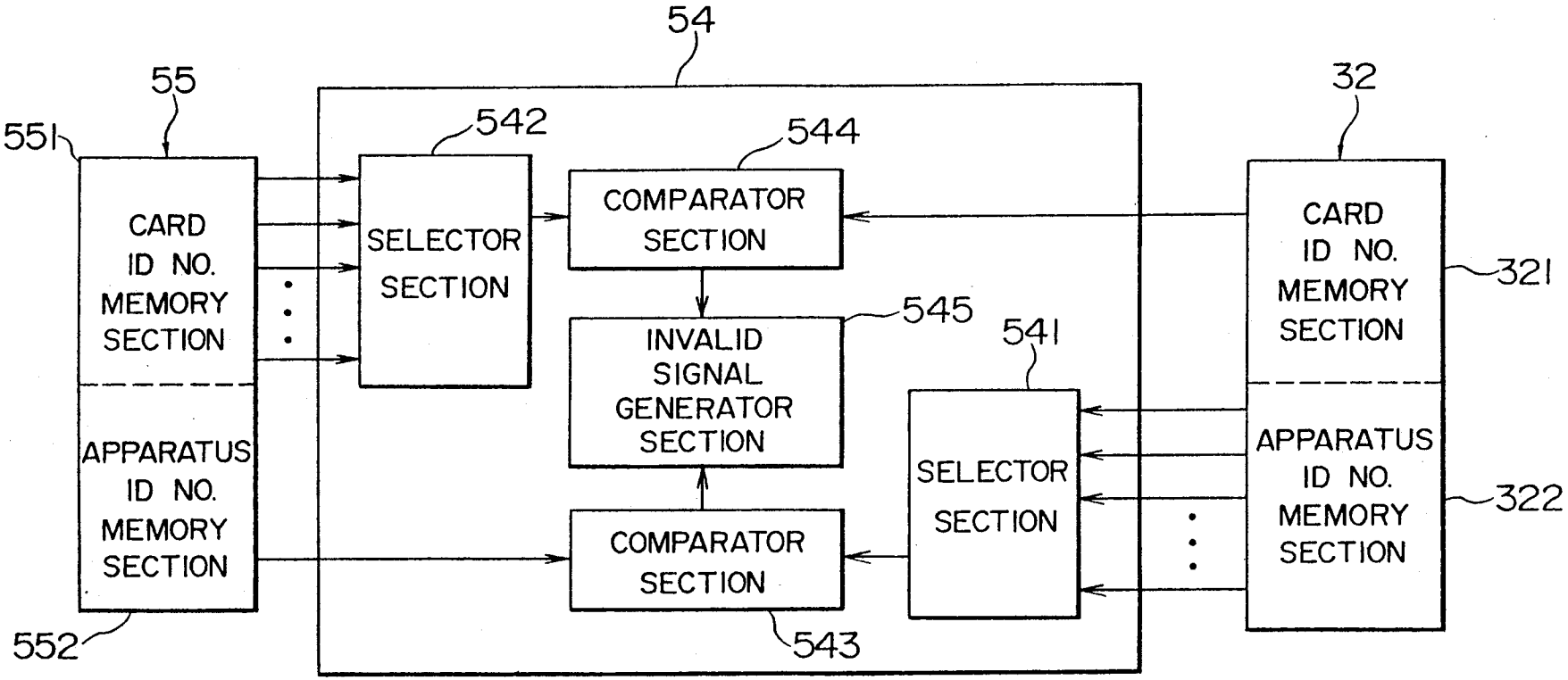
FIG. 5 is a block diagram of card check.

Referring now to FIG. 5 which is a detailed block diagram of card check, sending of the card-invalid signal will be explained as follows. As described above, whether the card 30 is valid or not, is checked by the ID number of the card 30 which is stored in the memory means 32. This check operation will be explained in detail in steps B18, B19, B24 and B25 which are shown in the following flow chart. The ID number memory means 32 of the card 30 comprises a card ID number memory section 321 which stores card ID numbers, and an image forming apparatus ID number memory section 322 which stores ID numbers of image forming apparatus to which the card 30 is available. In this case, card ID number is an ID number which is the number of the card itself, and image forming apparatus ID number is an ID number which corresponds to the manufacturing number of the image forming apparatus, and which is set in such a manner that one card 30 is available to a plurality of image forming apparatus.

A card ID number memory section 551 stores a plurality of card ID numbers which are available to the image forming apparatus. Image forming apparatus ID number memory section 552 stores the image forming apparatus ID number of the image forming apparatus. In this embodiment, the image forming apparatus ID number stored in the image forming apparatus, and the card ID number available to the apparatus, are previously stored in the memory means 45 of the first control means 40, and transferred to the second control means 50 by the aforementioned communication means 42, 52 and communication transmission means 60, and stored in the memory means 55. However, ID numbers are not necessarily stored in the manner described above. For example, they may be stored in the memory means 55 of the second control means 50 in advance.

When the card 30 is set to the setting section 29 in the image forming apparatus, it is judged by the judging means 54 of the second control means 50 whether the card 30 is valid or not. Specifically, this judgment is conducted in step A7 in a flow chart which will be explained later, and more specifically, in steps B18, B19, B24 and B25. In order to judge validity of the card 30, the judging means 54 is provided with selecting sections 541, 542, comparison sections 543, 544 and an invalid signal generating section 545.

Whether the card 30 is valid or not will be explained. First, the check of the ID number of the image forming apparatus will be explained as follows. As described above, a plurality of image forming apparatus ID numbers are stored in the card 30 so that the card 30 can be used for the apparatus. The stored ID numbers are selected by the selecting section 541 one by one. Whether the selected image forming apparatus ID number coincides with the image forming apparatus ID number stored in the memory means 55, is judged by the comparison section 543. When none of the image forming apparatus ID numbers stored in the card 30 coincide with the image forming apparatus ID number, an invalid signal is generated in the invalid signal generating section 545, and transferred to the first control means 40 by the card invalid transmission means 63. In this embodiment, check of the image forming ID number is conducted when the image forming apparatus ID number check mode is set. When the check mode is not set, the card invalid signal is not generated even when there is no coincidence. (Steps B33, B34)

Checking of the card ID number will be described as follows. As described above, a plurality of available card ID numbers are stored in an image forming apparatus. The stored card ID numbers are selected by the selecting section 542 one by one. Then, whether the selected card ID number coincides with the ID number stored in the card 30 or not, is judged by the comparing section 544. When none of the card ID numbers stored in the image forming apparatus coincide with the ID number of the card 30, an invalid signal is generated in the invalid signal generating section 545, and transferred to the first control means 40 by the card invalid transmission means 63. In this embodiment, checking of card ID numbers is conducted by setting the card ID number check mode, using the input means 46 and setting switch. When the check mode is not set, the card invalid signal is not sent even when the card ID number does not coincide. (steps B21 and B22)

The operation of the image forming apparatus according to the present invention is conducted in such a manner that: designation of a counter is previously transmitted from the first control means 40 to the second control means 50 through the communication transmission means 60 while the copy operation is not performed (which is shown in step A6 in the following flow chart); the memory means 55 in the second control means 50 or the card 30 stores the aforementioned designation of a counter; the first control means 40 generates count pulses at a predetermined timing of sequence control; the generated count pulses are transmitted to the second control means 50 by the count pulse transmission means 61; and the second control means 50 detects the count pulses, and counts the counter in the card 30 according to the designation stored in the memory means 55 of the second control means 50 or the card 30.

Figure 6:
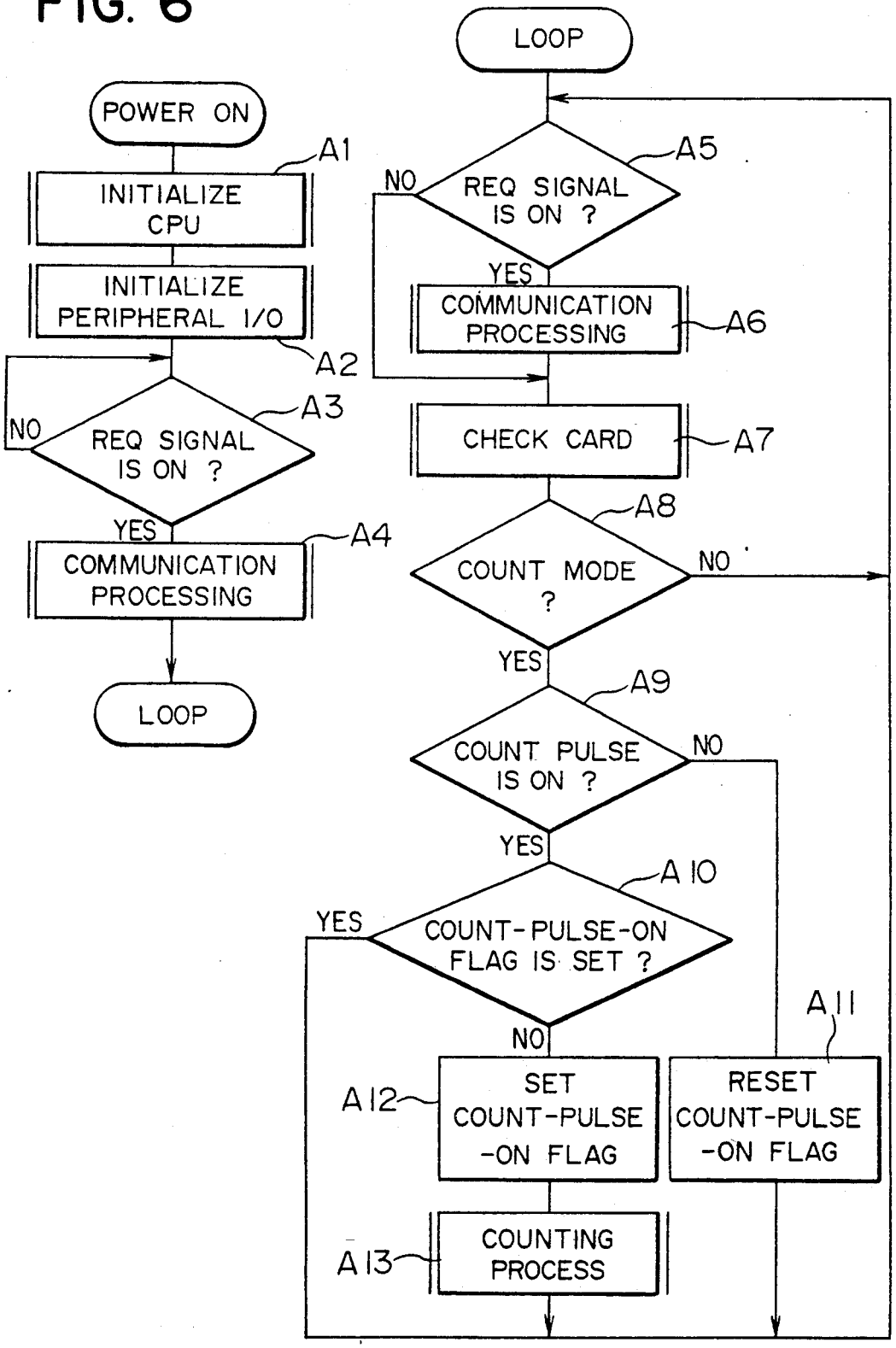
FIG. 6 is a flow chart of the second control means.

Referring now to FIG. 5 which is a block diagram of the second control means 50 and FIGS. 6 and 7 which are flow charts of card checking, motion of the second control means 50 will be explained as follows.

First, when the electric power source is turned on, the process advances to steps A1 and A2, and a CPU of the second control means 50 and peripheral I/O equipments are initialized, and then the process advances to step A3. In step A3, the motion stands by until REQ signal is inputted from the first control means 40. When REQ signal is received from the first control means 40, in other words, when data is sent from the first control means 40 through the communication transmission means 60, the process advances to step A4, and data is transferred to the second control means 50 according to the time chart shown in FIG. 4-*b*. This data is initial data. For example, the image forming apparatus ID number, card ID number available to this image forming apparatus, pass word, designation of a counter to perform counting, are sent in and stored by the memory means 55. After communication processing of initial data has been completed, the process advances to the next loop.

When data is sent from the first control means 40 in step A5, communication processing of step A6 is conducted. In this case, the data comprises a count mode start command which is sent when the card mode shown later is set, available card ID number, image forming apparatus ID number, section ID number, personal ID number, recording paper size, and image forming mode. Immediately after the power source has been turned on, an idling operation of the image forming apparatus is usually performed, so that the transmission processing of step A6 is not conducted, and a card check of the next step A7 is conducted. This step A7 will be described in detail later.

After the card check has been conducted in step A7, it is judged in step A8 whether it is in the count mode or not. That is, when it is the count mode, the process advances to the next step A9. On the contrary, when it is not the count mode, the process returns to the step A5.

In step A9, whether it is count-pulse-ON or not, is judged, which will be described later. In the case of count-pulse-ON, the process advances to step A10, and whether the count-pulse-ON flag is set or not is judged in step A10. In the case where the count-pulse-ON flag is set in step A10, the process returns to step A5. On the contrary, in the case where count-pulse-ON flag is not set in step A10, the count-pulse-ON flag is set in step A12, and count processing is performed in step A13, and after that, the process returns to step A5. When it is not count-pulse-ON in step A9, the process advances to step A11. In step A11, count-pulse-ON flag is reset, and the process returns to step A5.

In this case, the count processing in step A13 is to count the counter provided in the card 30 according to the counter designation which has been communication-processed in step A6.

Figure 8:
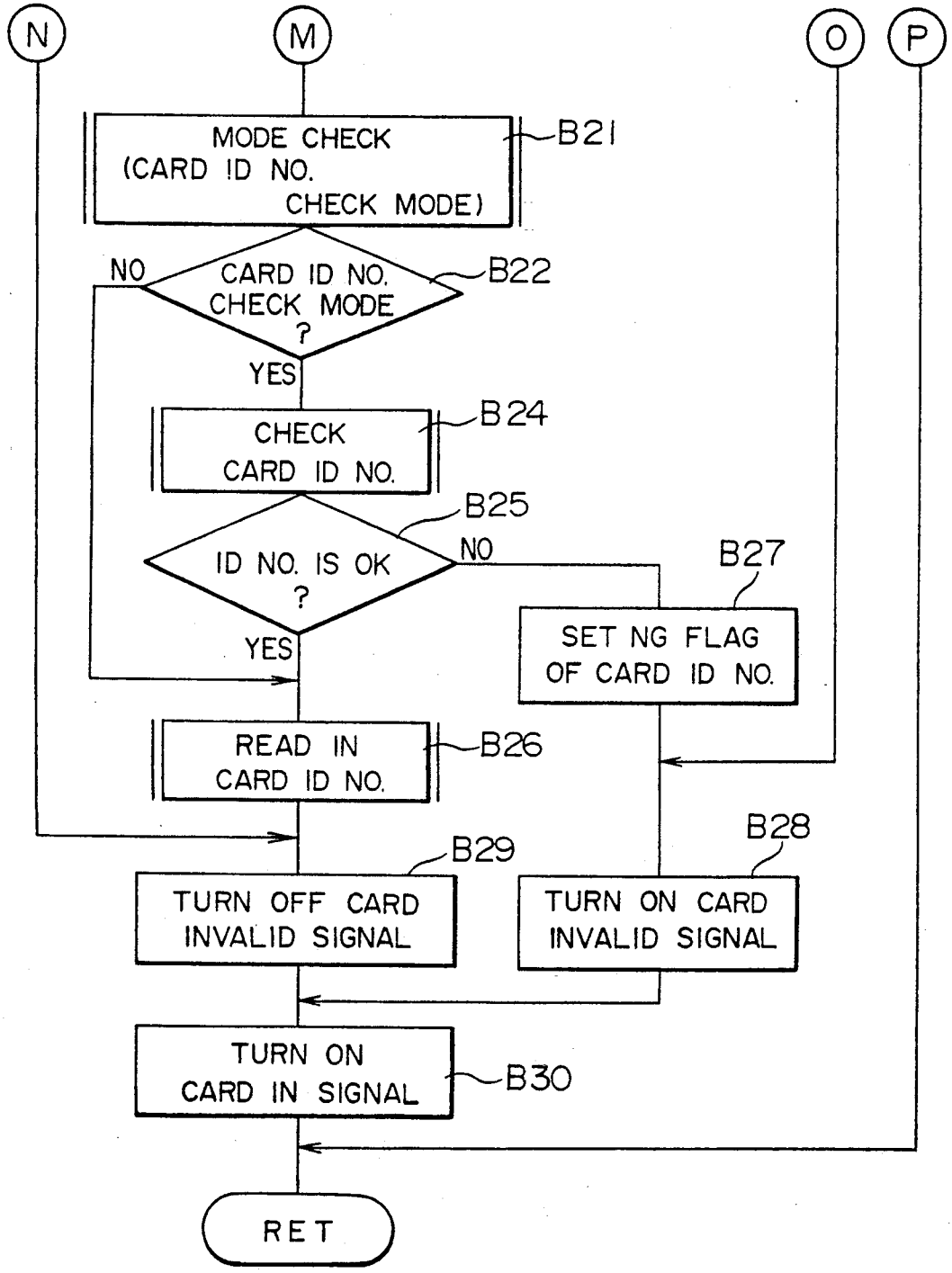
FIG. 8 is a flow chart of card check (check)

Next, the card check in step A7 conducted in the second control means 50 will be explained. FIGS. 7 and 8 will be explained, which are flow charts of card checking.

At first, the process advances to step A7 of the card check, and then further advances to step B1 and it is judged whether the card detection signal is ON or not. In the case where the card detection signal is ON, for example, one end of the terminals 31 of the card 30 is grounded, and when the card 30 is electrically connected with the terminal of the second control means 50, the detection means 58 detects that the card 30 has been set. In the case where the card detection signal is ON in step B1, the process advances to step B2. On the contrary, in the case where the card detection signal is not ON, the process advances to step B3. In step B3, it is judged whether the card detection flag is set or not. When the card detection flag is set, the card detection flag, card password NG flag, image forming apparatus ID number NG flag and card ID number NG flag are reset in step B4–step B10 so that the card ID number is cleared, and the card invalid signal and card-in signal are turned off. After that, the process returns to step A8. On the contrary, when the card detection flag is not set in step B3, the process returns to step A8.

In step B2, it is judged whether the card detection flag is set or not. When the card detection signal is set, the process returns to the aforementioned step A8, and when the card detection signal is not set, the process advances to step B11. In step B11, the card detection flag is set, and the process advances to steps B12 and B13. In steps B12 and B13, it is judged whether the mode is set to the test mode or not. When it is not the test mode, the process advances to steps B14 and B15, and when it is the test mode, the process advances to step B29. When the electric power source is turned on by a specific method, information that it is the test mode is sent to the second control means during communication processing of step A4. The test mode is set only when a service engineer conducts initial setting, adjustment or change of memory.

In steps B14 and B15, it is judged whether the card which has been set to the apparatus is a master card or not. When it is not the master card, the process advances to steps B31 and B32, and when it is the master card, the process advances to step B29. In this case, the master card is defined as a card with which a service engineer can operate all the image forming apparatus. That is, the image forming apparatus of any card ID numbers and image forming apparatus ID number can be operated with the master card.

In steps B31 and B32, it is judged whether the card password check mode is set or not. When the card password check mode is set, the process advances to steps B16 and B17, and when the card password check mode is not set, the process advances to step B33. In steps B16 and B17, the password is checked, and when the password is correct, the process advances to steps B33 and B34. When the password is not correct, the card password NG flag is set in step B20, and the process advances to step B28. The password is stored in the card 30 which is set to the setting section 29 of the card 30, and the stored password is compared with the password which is stored in the image forming apparatus. In other words, in the aforementioned step, whether the format of the card 30 is a predetermined one or not can be judged by the password in order to prevent forgery.

In steps B33 and B34, it is judged whether image forming apparatus ID number check mode is set or not. When image forming apparatus ID number check mode is set, the process advances to steps B18 and B19, and when forming apparatus ID number check mode is not set, the process advances to step B21. In steps B18 and B19, the image forming apparatus ID number is checked, and when the ID number coincides, the process advances to steps B21 and B22. When the image forming apparatus ID number does nor coincide, the image forming apparatus ID number NG flag is set in step B23, and the process advances to step B28. In this case, the image forming apparatus ID number is checked as follows. That is, it is judged whether the image forming apparatus ID number stored in the card 30 coincides with the image forming apparatus ID number stored in the image forming apparatus or not. In the aforementioned step A4 before step B18, the image forming ID number stored in the memory means 45 of the first control means 40 is transferred to the second control means 50 through the communication transmission means 60, and stored in the memory means 55. In step B18, a plurality of available image forming apparatus ID numbers which are stored in the ID number memory means 32 in the card 30, are successively read out by the selecting section 541 of the judging means 54. Then, it is judged in the comparing section 543 of the judging means 54 whether the read-out ID numbers coincide with the image forming apparatus ID number stored in the memory means 55, wherein the judgment is conducted on all the image forming apparatus ID numbers stored in the card 30. Of course, the judgment may be completed when the image forming apparatus ID number stored in the card coincides with that stored in the memory means 55 of the image forming apparatus.

In steps B21 and B22, it is judged whether the card ID number check mode is set or not. When the card ID number check mode is set, the process advances to steps B24 and B25, and when the card ID number check mode is not set, the process advances to step B26. In steps B24 and B25, the card ID number is checked, and when the card ID number coincides, the process advances to step B26, and when the card ID number does not coincide, the card ID number NG flag is set in step B27, and then the process advances to step B28. In this card ID number check mode, the ID number stored in the card and the available ID number stored in the image forming apparatus are checked. Whether this mode is set or not, is previously detected by the input means 46 and setting switch which are provided to the image forming apparatus body, and this mode is transmitted from the first control means 40 to the second control means 50 through the communication means 60 when the initial communication processing of step A4 is conducted, and stored in the memory means 55. This card ID number check is conducted in the same manner as the aforementioned image forming apparatus ID number check.

In step B26, the card ID number stored in the card 30 is read out by the reading-out/writing-in means 51 of the second control means, and stored in the memory means 55, and then the card invalid signal is made to be OFF in step B29, and the process advances to step B30. When the results of the check conducted with the password, image forming apparatus ID number and card ID number in steps B17, B19 and B25, show disagreement, the card invalid signal is turned on in step B28, and the process advances to step B30. In step B30, the card signal is turned on, and the process returns to step A8. In the manner described above, the card check is completed. The card invalid signal and card-in signal are respectively transferred from the second control means 50 to the first control means 40 by the exclusive card invalid transmission means 63 and card-in transmission means 62.

Figure 9:
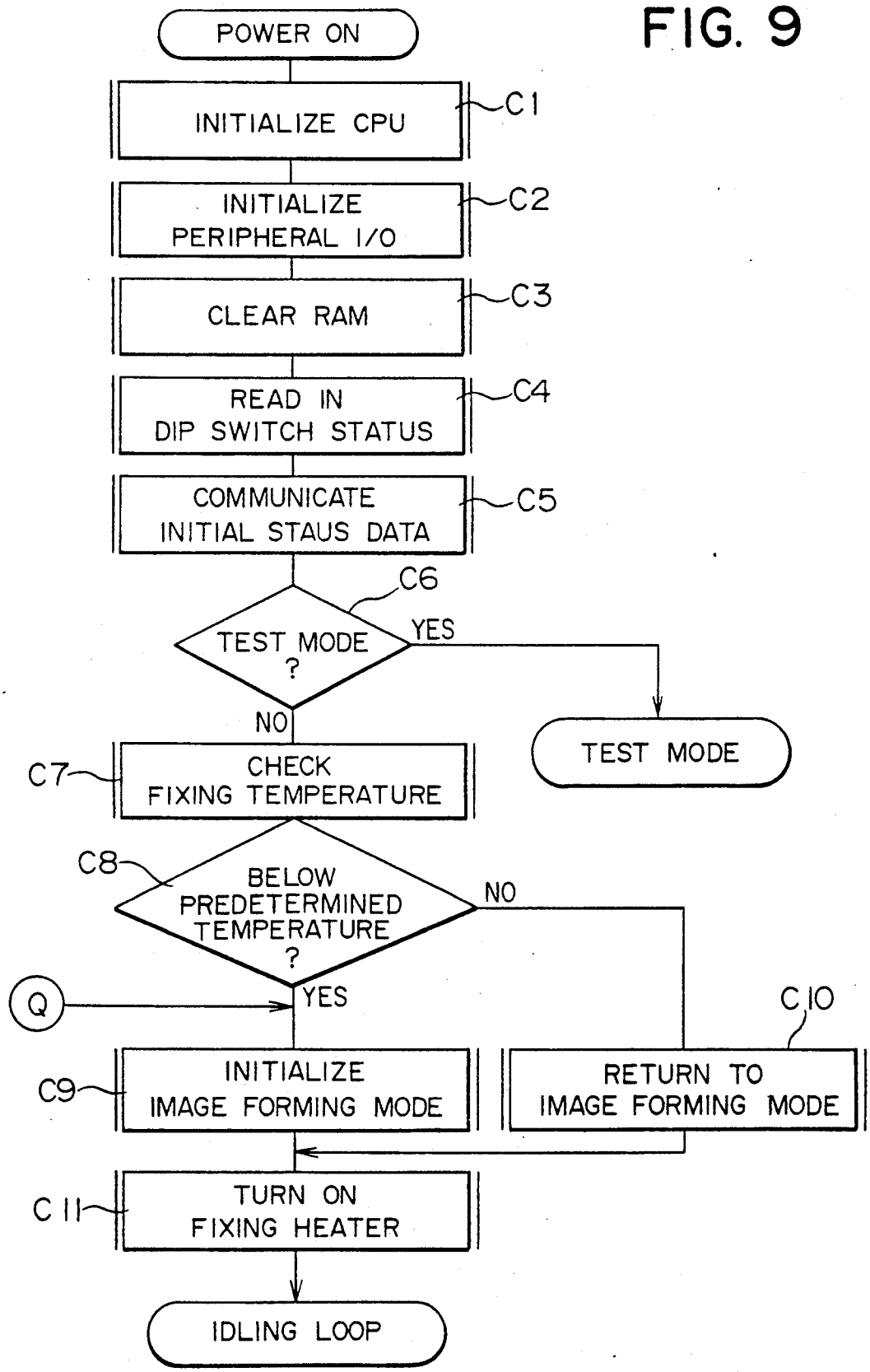
FIG. 9 is a flow chart of sequence control performed by the first control means.
Figure 10:
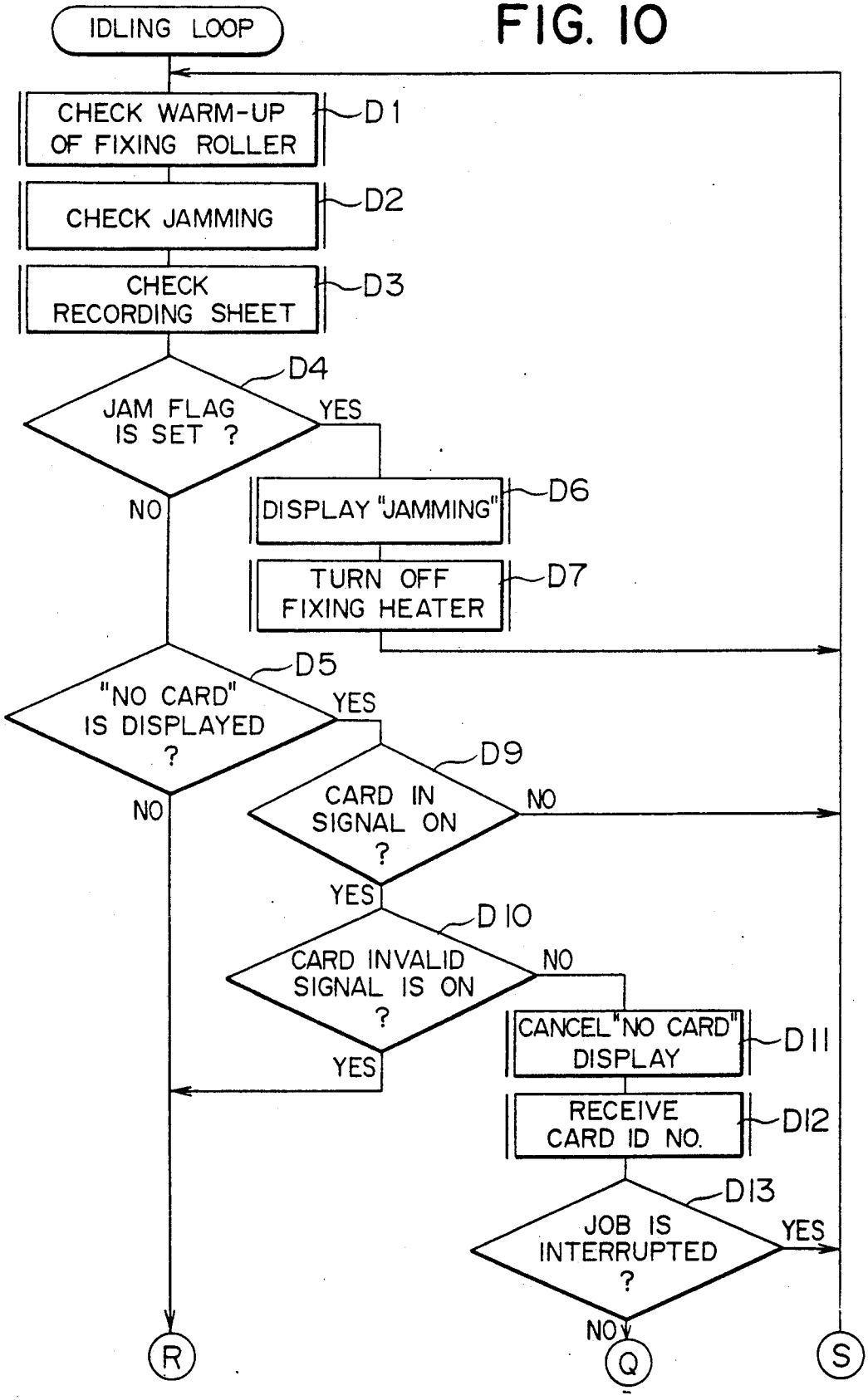
FIG. 10 is a flow chart which follows FIG. 9, and shows an idling loop.
Figure 11:
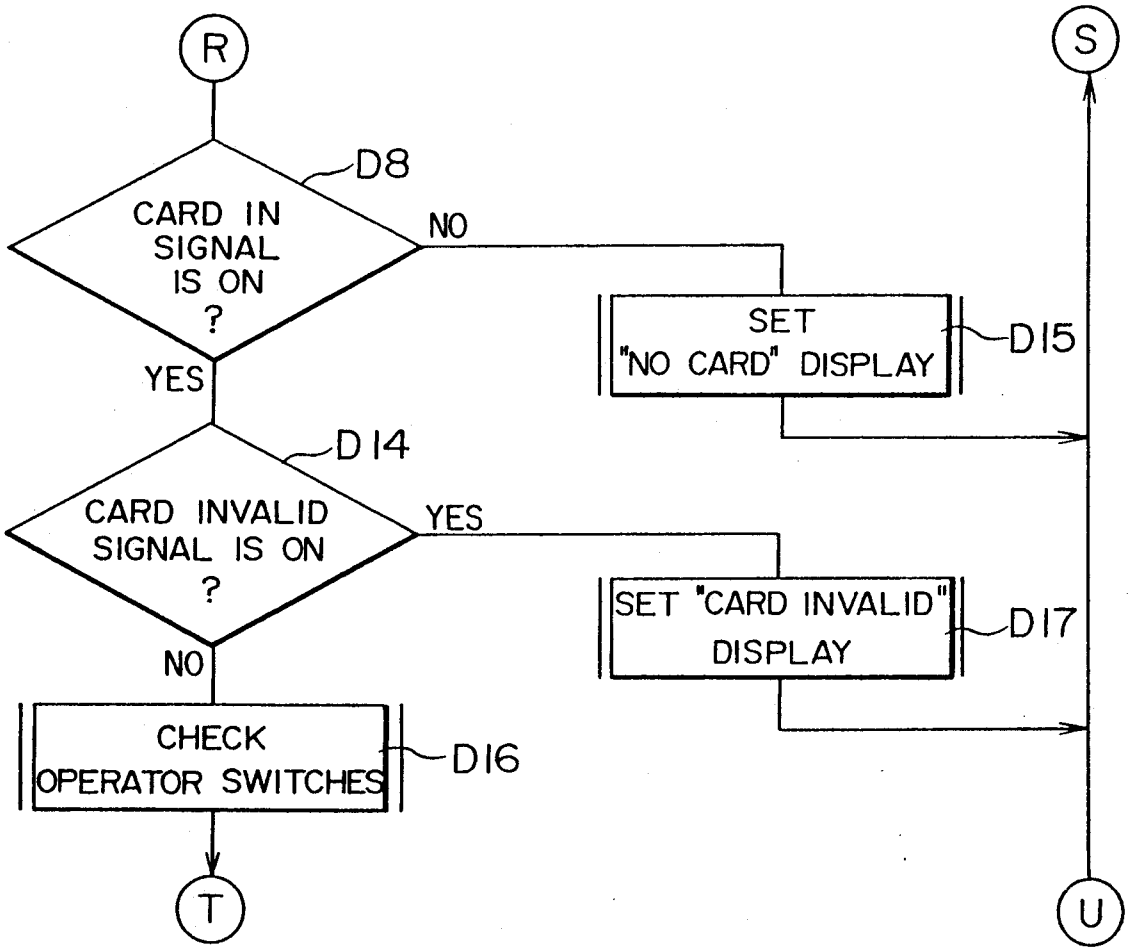
FIG. 11 is a flow chart which follows FIG. 10, and includes the detection of a memory card IN signal.
Figure 12:
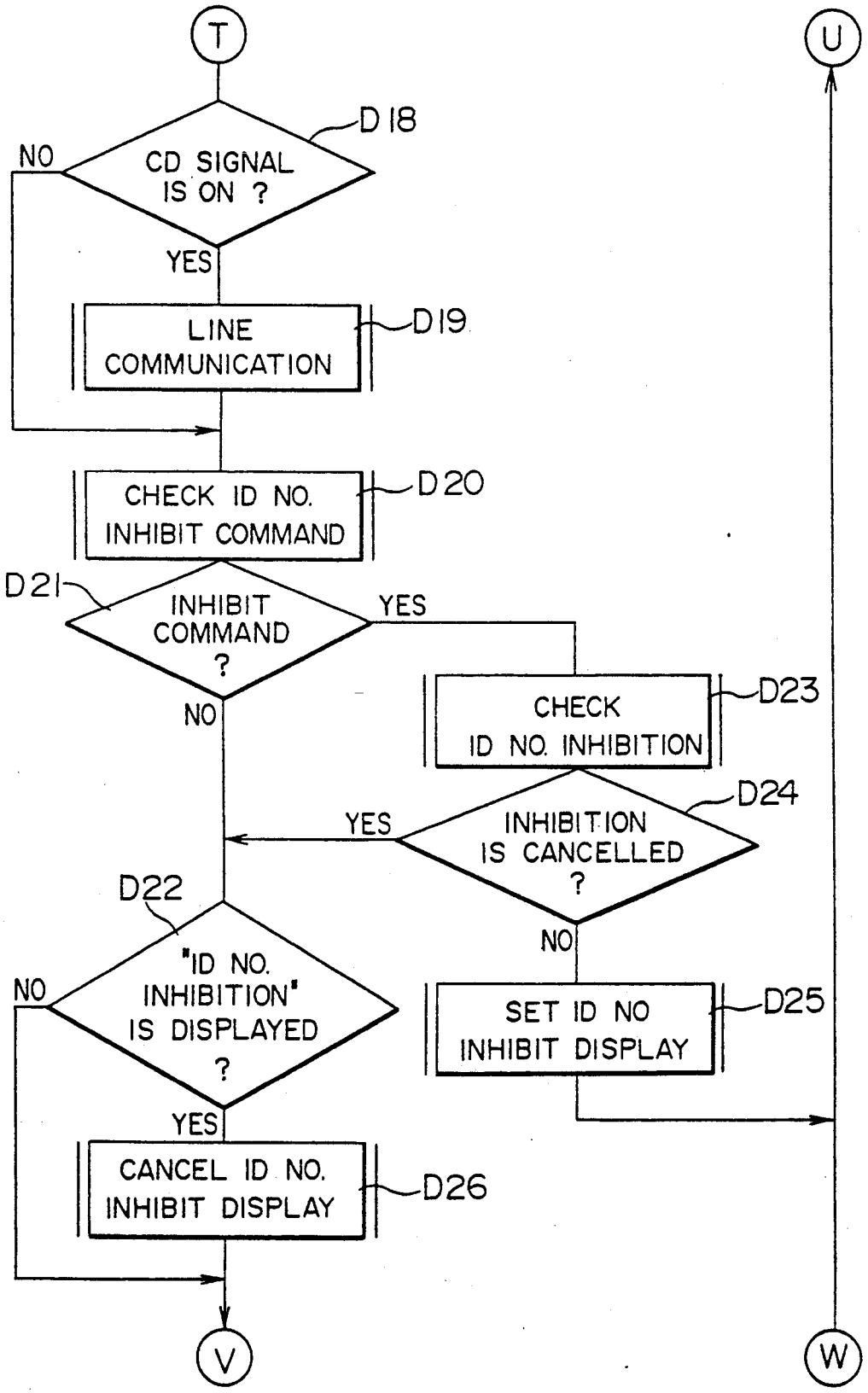
FIG. 12 is a flow chart which follows FIG. 11, and includes the check of passwords.
Figure 13:
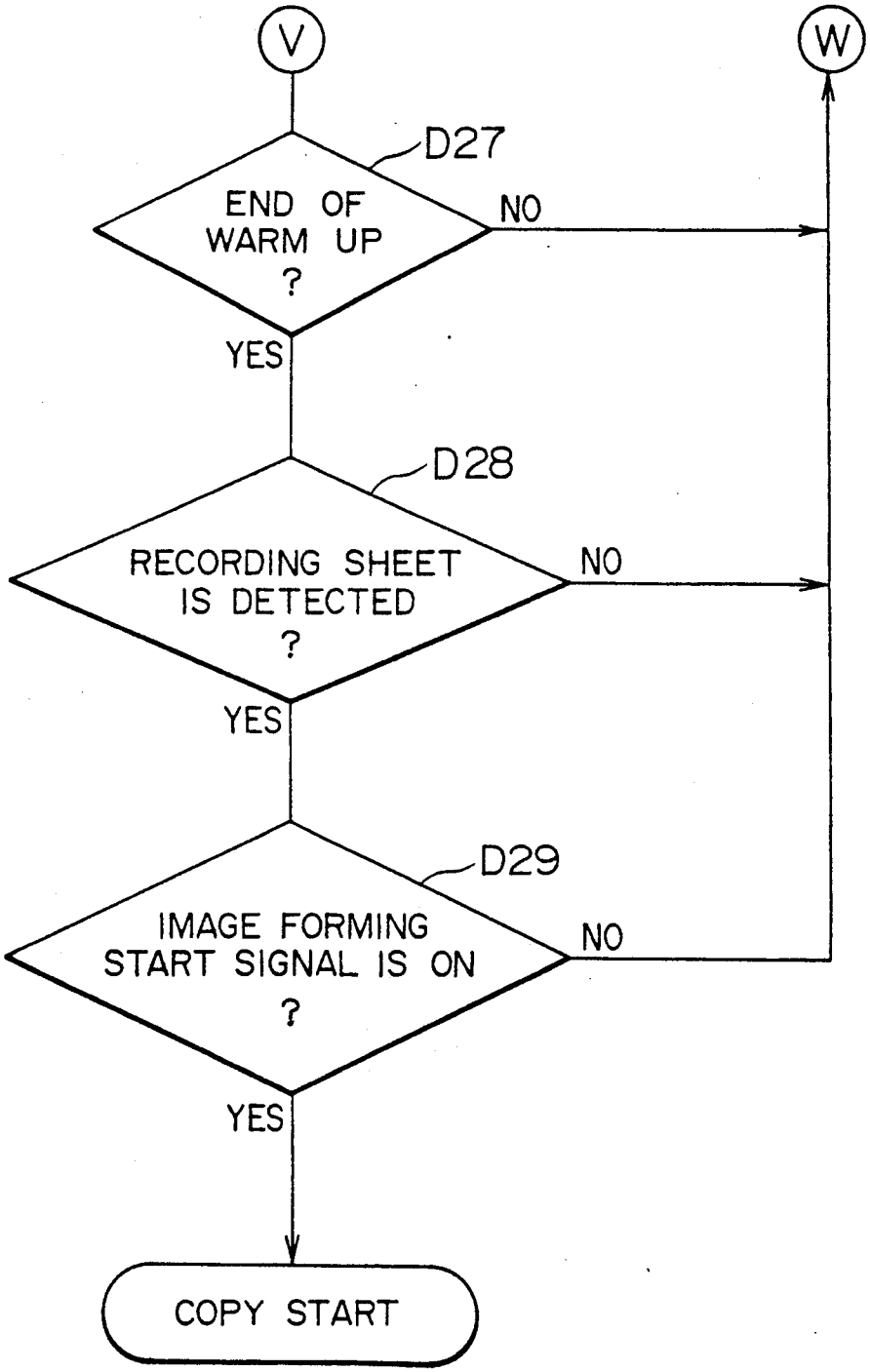
FIG. 13 is a flow chart which follows FIG. 12, and shows the operation until copy start, which follows FIG. 12.
Figure 14:
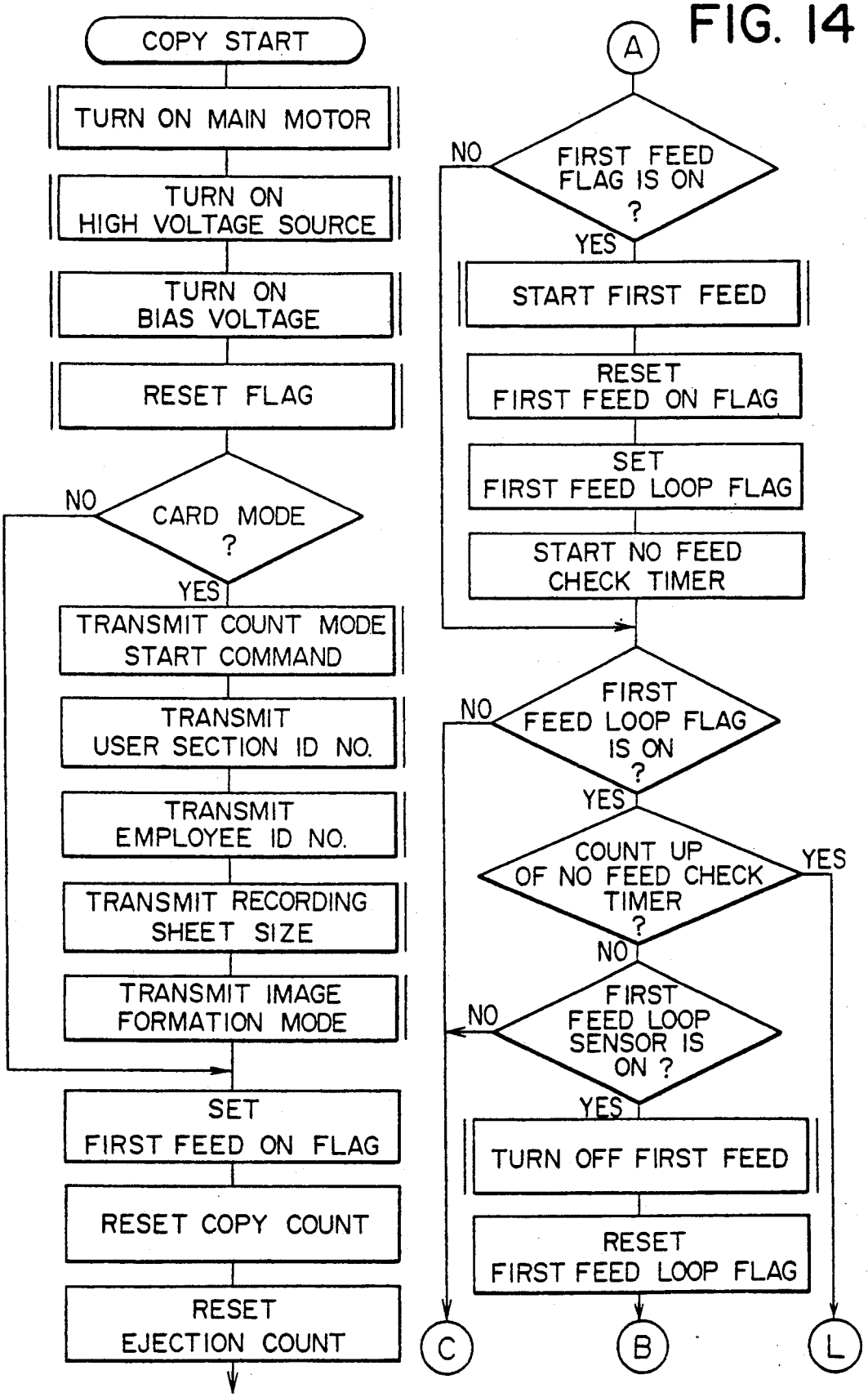
FIG. 14 is a flow chart which follows FIG. 13, and shows the operation from copy start.

Referring now to FIG. 9 which is a flow chart of the first control means 40, and FIGS. 10–13 which are flow charts of idling loops, the operation of the first control means 40 will be explained as follows.

First, the power source of the image forming apparatus is turned on. Then, the CPU is initialized in step C1, peripheral I/O is initialized in step C2, RAM is cleared in step C3, a dip switch is read in in step C4, and the process advances to step C5. In step C5, initializing communication (corresponding to step A4) which transfers initial data to the second control means 50, is conducted, and the process advances to step C6. In step C6, it is judged whether the mode is set to be the test mode or not. When it is the test mode, the process advances to the test mode, and when it is not the test mode, the process advances to steps C7 and C8. As described before, the test mode is set only when a service engineer conducts initial setting, adjustment or change of memory. For example, when the ten keys on the operation panel are pressed synchronously with switching-on of the power source, the test mode is set.

In steps C7 and C8, the temperature of the fixing means 24 is checked in order to find out whether it is a predetermined temperature or not. When the temperature is lower than the predetermined fixing temperature, the image forming mode is initialized in step C9, and when it is higher than the predetermined fixing temperature, the image forming mode is returned to step C10, and in both cases the process advances to step C11. In step C11, a fixing heater, which is a heat source of the fixing means 24, is turned on, and then the process advances to the idling loop.

In the idling loop, warming up of the fixing means 24 is checked in step D1, the occurrence of jamming in a transfer sheet passage is checked in step D2, the paper feed cassette 18 and the transfer sheet in the paper feed cassette 18 are checked, and the process advances to step D4. In step D4, it is judged whether the jam flag is set or not. When the jam flag is not set, the process advances to step D5, and when the jam flag is set, the occurrence of jamming is indicated by the indicating means 48 in step D6, and the fixing heater is turned off in step D7. Then, the process returns to the step D1.

In step D5, it is judged whether the indication which indicates that there is no card, is conducted by the indication means 48 on the indicating section (not shown) provided on the operation panel (not shown), or not. When it is not indicated, the process advances to step D8, and when it is indicated, the process advances to step D9. In step D9, it is judged whether the card-in signal is ON (step B30) or not. When it is ON, the process advances to step D10, and when it is not ON, the process returns to the step D1. In step D10, it is judged whether the card invalid signal is ON (step B28) or not (step B29). When it is ON, the process advances to step D8, and when it is not ON, the indication which shows that there is no card, is cleared in step D11, and in step D12, the card ID number is received from the second control means 50 through the communication transmission means 60, and the process advances to step D13. In step 13, it is judged whether the process will interrupt a copy operation or not. When a copy operation is interrupted, the process returns to step D1, and when it is not interrupted, the process returns to step C9.

In step D8, it is judged whether the card-in signal is ON (step B30) or not, and when it is ON, the process advances to step D14. That is, when the detection means 58 detects that the card 30 has been set to the apparatus, judgment is conducted by the card-in signal inputted into the judging means 44 through the card-in transmission means 62. On the contrary, when the card-in signal is not ON, the indication showing that there is no card, is conducted in step D15, and the process returns to step D1. That is, when the card 30 is not set, the card-in signal is not turned on by the detection means 57, so that a signal can not be sent to the card-in transmission means 62. Accordingly, the judging means 44 judges that there is no signal, and a message, for example, "Please set a card." is displayed on the indicating section of the operation panel by the indicating means 48.

In step D14, it is judged whether the card invalid signal is ON (step B28) or not (step B29). When it is not ON, the process advances to step D16, and when it is ON, the indication of invalid card is set in step D17, and the process advances to step D1. The invalid card signal is inputted into the judging means 44 from the judging means 54 through the invalid card transmission means 63. The indication of the invalid card is displayed on the indicating section by the indicating means 48, for example, "This card card is not available".

In step D16, various operation buttons on an operation panel (not shown) are checked, and the result of the check is processed according to each subroutine. After that, the process advances to step D18. Step D18–step D26 are shown in a flow chart in the case where the image forming apparatus of the present invention is connected with a host computer through a telecommunication line. After step D18–step D26 have been completed, the process advances to step D27.

In step D27, it is judged whether warming-up of the fixing means 24 has been completed or not. When it has been completed, the process advances to step D28, and when it has not been completed yet, the process returns to step D1. In step D28, it is judged whether transfer sheets P are in the paper supply cassette 18 or not. When transfer sheets P are in the paper supply cassette 18, the process advances to step D29, and when they are not in the paper supply cassette 18, the process returns to step D1.

In step D29, it is judged whether the image formation start command is ON or not. When it is ON, the process enters into a copy start routine, which will be described later. When it is not ON, the process returns to step D1. When a copy button provided on the control panel is pressed, this image formation start command is ON (inputted) through the input means 46.

Referring to FIG. 14–FIG. 18, a flow chart after copy start will be briefly explained here because the flow chart is almost the same as that of the copy process.

When the copy button is pressed, the copy operation starts (in other words, the mode is set to the copy mode). Then, the main motor and high voltage power source is turned on, and the copy count and paper discharge count are reset. After that, the first paper roller 19 is turned on. In the image forming apparatus of the present invention, the counters corresponding to the items which have been determined by the time of copy start, are transferred from the first control means 40 to the second control means 50 by the time when the first paper feed roller 19 is turned on while copying is not conducted. For example, the card ID number, section ID number, person ID number, transfer sheet size ID number, and image formation mode are inputted into the apparatus by pressing various press buttons provided on the control panel, and designated by the counter designation means.

Figure 15:
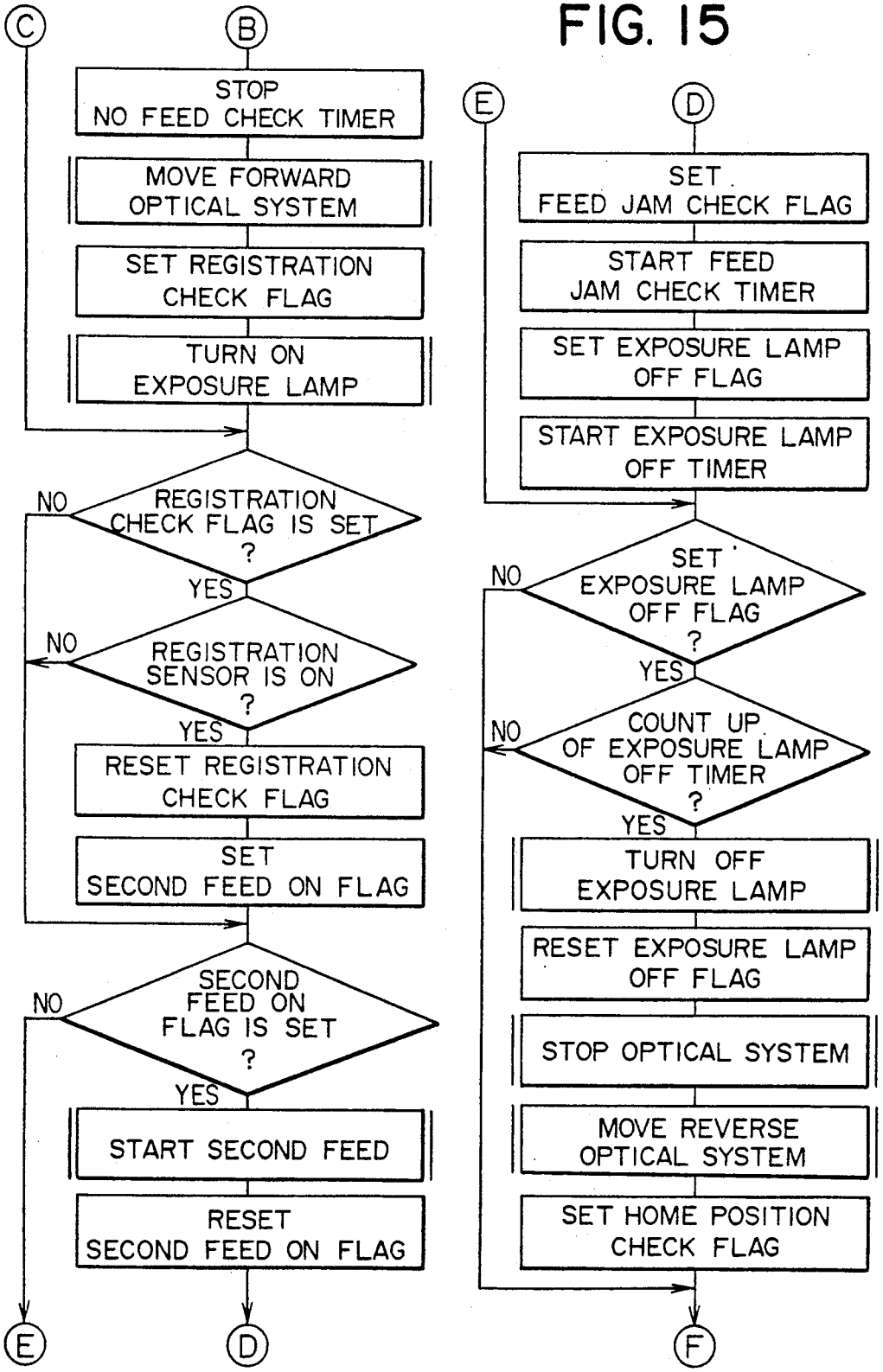
FIG. 15 is a flow chart which follows FIG. 14, and mainly shows the exposure and the first paper feeding.
Figure 16:
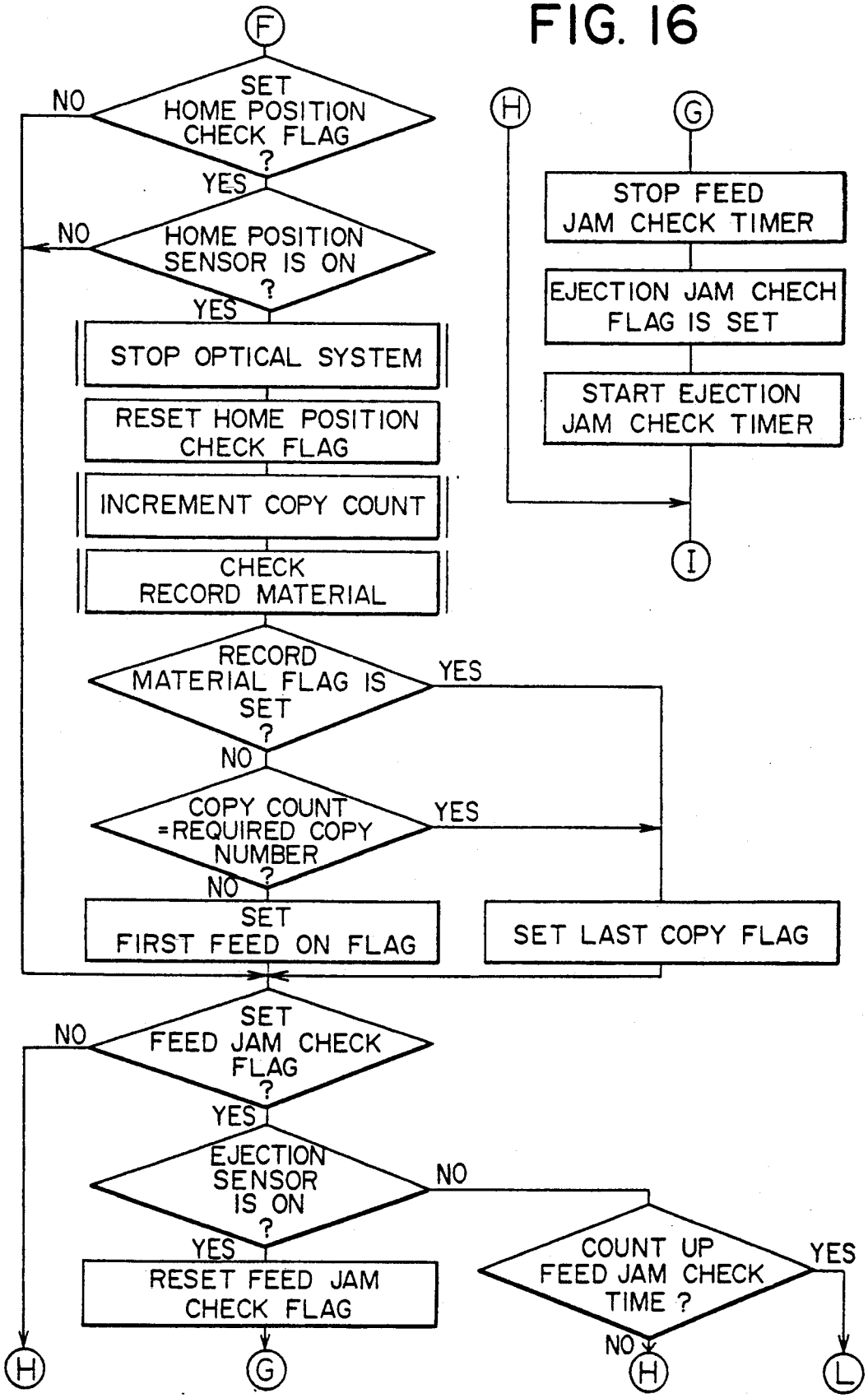
FIG. 16 is a flow chart which follows FIG. 15, and includes jam detection.
Figure 17:
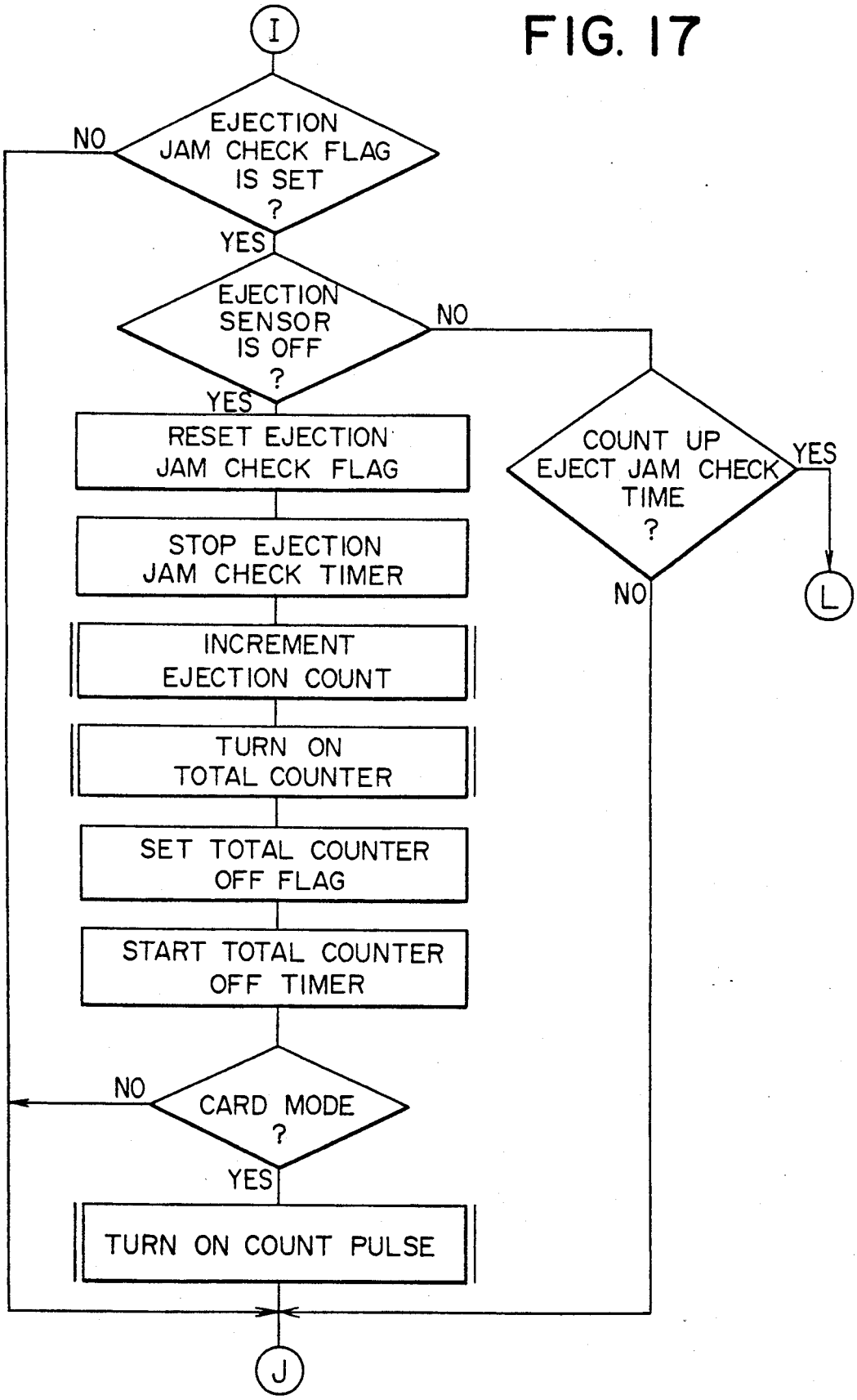
FIG. 17 is a flow chart which follows FIG. 16, and includes the detection by a paper discharge sensor.
Figure 18:
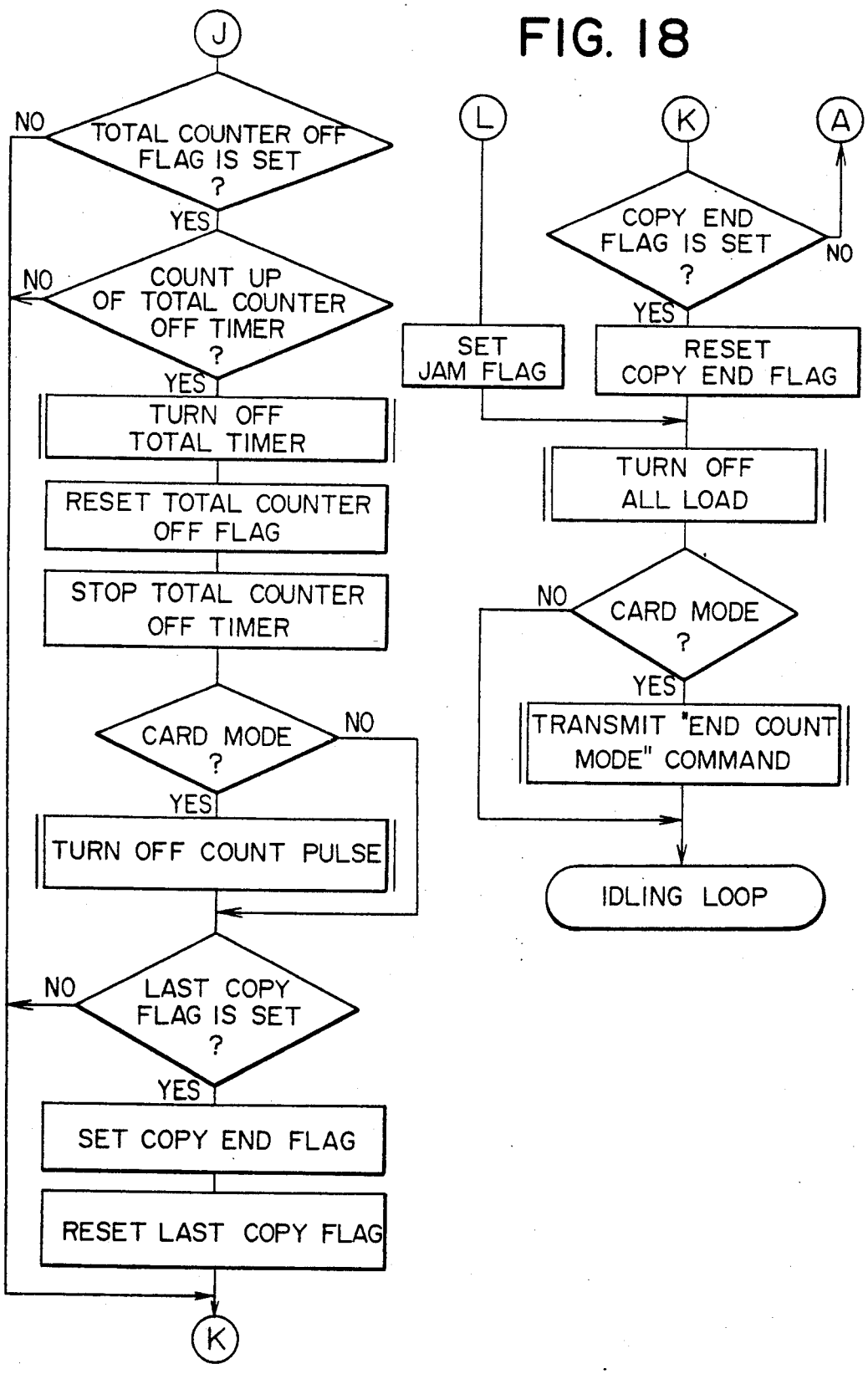
FIG. 18 is a flow chart which follows FIG. 17 and shows the operation until the return to an idling loop.

After the first paper feed has been completed, the process advances to the flow shown in FIG. 15, and optical scanning is conducted on a document. After that, the second paper feed (the timing roller 20) is turned on. After optical scanning has been completed, the optical scanning system starts to return to its home position. In FIG. 16, the returning operation of the optical system is stopped, and value 1 is added to the copy count and its value is displayed on the indicating section of the image forming apparatus. The aforementioned value is compared with a set number. When the paper discharge sensor becomes ON, a conveyance jam check timer stops, and a paper discharge jam check timer starts. Then, the process transfers to the flow illustrated in FIG. 17. When the paper discharge sensor becomes OFF, value 1 is added to the paper discharge count, and the total counter is turned on. Next, the count pulse is turned on. The pulse waveform is transferred to the count pulse detection means 53 of the second control means 50 from the count pulse generation means 43 of the first control means 40 through the count pulse transmission means 61 by the time of count pulse OFF shown in FIG. 18, so that the transferred waveform is counted by the counter previously designated.

When a copy completion flag is set, all loads are made to be OFF, and the command of count mode completion is sent. Then, the process advances to the idling loop. When the copy completion flag is not set, the process returns to the flow shown by A in FIG. 14, and copy control is repeated. In this case, there is no change in the counters, so that only count pulses are transferred during the repetition of copy operation, and when one copy operation has been completed, counting is conducted by the counter according to the designation of counter stored in the memory card 30.

As described above, according to the present invention, copying can be conducted utilizing a plurality of copiers and outer memory means. When a plurality of copiers are used, the total copy number can be counted by the outer memory means. In the manner described above, the plurality of copiers can be freely utilized by the plurality of outer memory means in the possession of each person, and the check of the ID number can be conducted on both the outer memory means side and the image forming apparatus side. Further, the check in which the outer memory means and the image forming apparatus are combined can be also conducted.

According to the conventional method, in the case of the image forming apparatus to which a memory card is applied as an outer memory means, the more the number of counters, the more the processing time, so that sequence control is affected. However, in the present invention, control is not affected by the number of counters at all, and sequence control is conducted by the first control means. Accordingly, the operation rate is remarkably increased.

Further, the available image forming apparatus ID number stored in the portable memory means, and the ID numbers stored in the image forming apparatus are compared by the second control means. The result of comparison is sent not through a telecommunication line but through an exclusive line, processing time can be reduced, and the operation program can be simplified. Furthermore, the portable memory means can be easily and quickly checked.

What is claimed is:

1. An image forming apparatus comprising:

portable memory means adapted to be connected to the main body of the image forming apparatus for memorizing therein a portable memory identification number to identify the portable memory means and a plurality of usable apparatus numbers to represent the usable image forming apparatuses which are to become usable by the connection of the portable memory means;

inner memory means provided in the main body of the image forming apparatus for memorizing an apparatus identification number to identify the same image forming apparatus and a plurality of acceptable portable memory numbers to represent acceptable portable memory means for the same image forming apparatus;

first checking means provided in the main body for checking if the apparatus identification number coincides with any of the plurality of the usable apparatus numbers;

second checking means for checking if the portable identification number coincides with any of the plurality of the acceptable portable memory numbers;

mode selecting means for selecting a check mode from a plurality of predetermined check modes, each check mode determining if each check by the first checking means and the second checking means is to be performed or not; and judging means for judging usability of the image forming apparatus by the connection of the portable memory means, which permits the image forming apparatus to perform an image forming operation based on a check result under the selected check mode.

2. The image forming apparatus of claim 1, wherein the check modes includes a test mode for executing a maintenance of the image forming apparatus, the maintenance including modification of memorized data in the portable means and the inner memory means.

3. The image forming apparatus of claim 1, further comprising:

counting means provided in the main body for counting a number of consumed recording sheets during a copying process of the image forming apparatus;

classification means for classifying the counted number into a data group selected from a plurality of predetermined data groups; and count memory means having a plurality of memory sections, for storing data of the counted number into the memory section according to the data group.

* * * * *